US005183258A

United States Patent [19]

Lerke

[11] Patent Number: 5,183,258

[45] Date of Patent: Feb. 2, 1993

[54] MAP READING GAME APPARATUS

[76] Inventor: Charles J. Lerke, P.O. Box 234, Whitehouse, N.J. 08888

[21] Appl. No.: 794,522

[22] Filed: Nov. 19, 1991

[51] Int. Cl.[5] ..... A63F 3/04

[52] U.S. Cl. ..... 273/252

[58] Field of Search ..... 273/242, 243, 246, 248, 273/249, 251, 252, 254

[56] References Cited

U.S. PATENT DOCUMENTS

| | | | |
|---|---|---|---|
| 3,572,718 | 3/1971 | Moore | 273/254 |
| 3,883,142 | 5/1975 | Spohn | 273/251 |
| 3,947,038 | 3/1976 | Archer | 273/254 |
| 4,097,051 | 6/1978 | Goldberg et al. | 273/254 |
| 4,784,394 | 11/1988 | Sumin | 273/251 |
| 5,050,883 | 9/1991 | Goldfarb et al. | 273/251 X |

FOREIGN PATENT DOCUMENTS

| | | | |
|---|---|---|---|
| 1414464 | 11/1975 | United Kingdom | 273/254 |
| 2205254 | 12/1988 | United Kingdom | 273/254 |
| 2208269 | 3/1989 | United Kingdom | 273/251 |
| 2211750 | 7/1989 | United Kingdom | 273/254 |
| 8103622 | 12/1981 | World Int. Prop. O. | 273/251 |

OTHER PUBLICATIONS

"A Play on History", *Mississippi Magazine*, Anne Gillespie, Mar./Apr., 1990, pp. 11, 12, 14, 7, and 8.

*Primary Examiner*—V. Millin
*Assistant Examiner*—William E. Stoll
*Attorney, Agent, or Firm*—Richard R. Muccino

[57] ABSTRACT

A board game apparatus which educates the player about the culture of a geographic entity, such as a city and improves map reading skills. The apparatus includes a playing board having thereon a representation of a geographic entity including points of interest and streets, at least one point of interest card showing the points of interest on the playing board, a travel itinerary card which lists the points of interest that must be reached by the player and event cards which identify a cultural event located on the playing board.

9 Claims, 6 Drawing Sheets

FIG. 4

20

EVENT: "CRUISIN' FRIDAY NIGHT"
DATE: FRIDAY NIGHTS, JUNE TO OCTOBER

THIS WEEKLY EVENT IS AN INFORMAL GATHERING OF CLASSIC AUTOMOBILE OWNERS AND ENTHUSIASTS OF 1950'S & 60'S CARS. THE SHOW INCLUDES 50'S MUSIC PLAYED BY A LOUDSPEAKER AND AWARDS FOR THE BEST CAR.

38

STARTING FROM THE "EVENTS" SPACE, THE BEARER OF THE CARD MAY TRAVEL TO ANY ONE SPACE CONTAINED ALONG THE CAR SHOW ROUTE SHOWN BELOW:

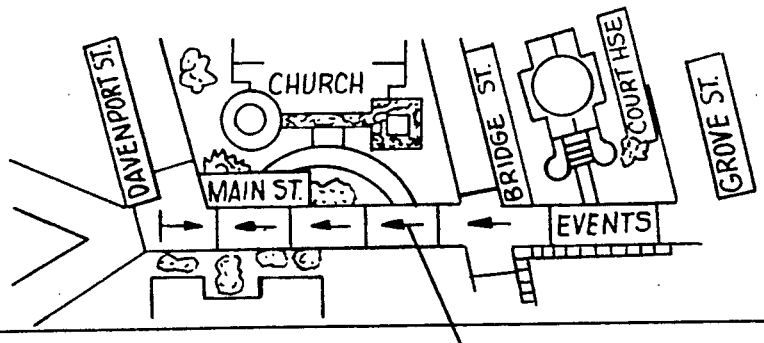

40

MAP READING GAME APPARATUS

FIELD OF THE INVENTION

The present invention is generally directed to a board game device which develops map reading skills and enables participants to gain familiarity with the culture of individual cities.

BACKGROUND OF THE INVENTION

A number of existing board game devices are concerned with travel between a starting point and a selected destination. Some of these devices employ a political entity such as the continental United States using various cities as the starting point and destination. Other board game devices depict a more local geography by employing a grid of streets and highways as the arena in which travel is conducted.

While each of these board games seek to provide an educational benefit, they are principally concerned with traffic controls, underlying road hazards, modes of transportation, and revenue generation, and not with the development of those skills which enhance map reading.

For example, U.S. Pat. No. 3,658,337, issued to Peters et al., discloses a board game of the continental United States in which major cities have alternate routes and modes of transportation. The object of the game is to move from one city to another using alternate routes and different modes of transportation.

U.S. Pat. No. 4,054,289, issued to Burkett, discloses a board game which simulates the flow of traffic through a community and utilizes traffic rules which restrict the flow of traffic through the streets of the community.

U.S. Pat. No. 4,087,094, issued to Bakay, discloses a board game having intersecting thoroughfares. Cards are selected to move game pieces along the thoroughfares while hazard cards and traffic signals are designed to hinder the advancement of the game pieces.

U.S. Pat. No. 4,109,917, issued to Hatcher discloses a board game which simulates the movement of trucks across the United States. Symbols are placed along the routes which advance or retard movement of the trucks.

U.S. Pat. No. 4,290,607, issued to McDonald, is directed to a travel board game in which multiple sets of game cards are used to generate revenue along a simulated route.

U.S. Pat. No. 4,375,889, issued to Burkett, is another board game device simulating the flow of traffic in which the game pieces are primarily controlled by the selection of traffic violation cards which impede the progress of the game pieces.

U.S. Pat. No. 4,953,871, issued to Antwi, discloses a board game of a hypothetical community employing traffic control parameters which determine the rate at which a game piece proceeds from a starting point to a final destination.

None of these prior art board games provides the player with the opportunity to develop those motor and cognitive skills necessary to develop a facility for map reading and to learn the actual landmarks and cultural events of a selected city.

SUMMARY OF THE INVENTION

The present invention is directed to a board game apparatus for educating a player about the culture of a geographic entity comprising:

(a) a playing board having thereon a representation of a select geographic entity including points of interest and streets, the streets being divided into a plurality of spaces for receiving a game piece, wherein a minor portion of said spaces are event spaces;

(b) at least one game piece per player for moving along said spaces;

(c) at least one point of interest card for each player having thereon points of interest shown on the playing board;

(d) a travel itinerary card for each player having described thereon at least one point of interest that must be reached by the player;

(e) means for selecting a number of spaces for moving the game piece along a street in the direction of a point of interest described on said players point of interest card and travel itinerary card; and (f) a plurality of event cards identifying a cultural event located on the playing board such that when a player lands on an event space, the player selects an event card and moves one of his game pieces to any space identified by the event shown on the event card.

BRIEF DESCRIPTION OF THE DRAWINGS

The following drawings illustrate embodiments of the invention and are not intended to limit the invention as encompassed by the claims forming part of the application.

FIG. 4 is a perspective view of an event card used in the present invention.

DETAILED DESCRIPTION OF THE INVENTION

Figure 1A:
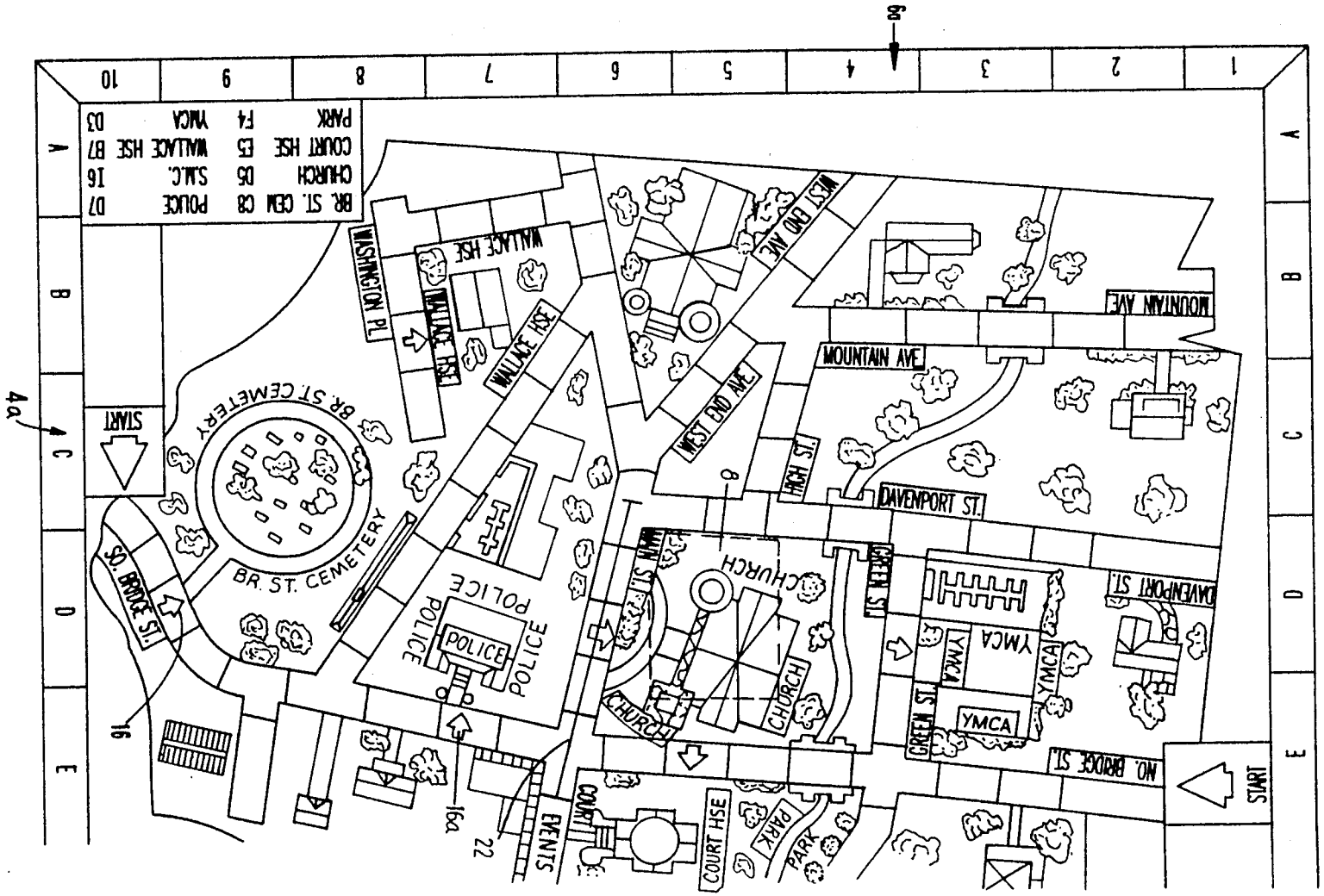
FIGS. 1*a* and 1*b* are a plan view of one embodiment of the playing board of the invention.

The present invention is directed to a board game apparatus for amusement and educational purposes in which the players are educated about the cultural events of a geographic entity such as a city. In the course of playing the board game apparatus, one develops those skills which are particularly suited to map reading.

More specifically, the board game apparatus comprises a playing board having thereon a representation of a selected geographic entity such as a city. The playing board identifies points of interest and the location of cultural events that are most closely identified with the city. The location of the points of interest and cultural events is made by representations of the actual streets of the city each of which is divided into a plurality of spaces.

The perimeter of the opposed sides of the playing board is preferably provided with letter and number indices which define a series of grids such as customarily employed on maps. The grids enable the players to readily identify the position of the points of interest and cultural events.

There is also provided at least one game piece for each player. The game pieces move from space to space along the streets in accordance with a number obtained from a roll of the dice or by spinning a standard round spinning device having numbers spaced along the circumference.

Each player is provided with at least one point of interest card which identifies, by suitable word and/or pictorial indicia, a particular place of interest located on the playing board. In a preferred form of the invention, each player is provided with ten point of interest cards.

In addition to the point of interest cards, each player is given a single travel itinerary card which displays thereon by word and/or pictorial indicia at least one point of interest. The number of points of interest listed on the travel itinerary card will correspond to the number of point of interest cards held by each player.

The board game apparatus also includes a plurality of cultural event cards which are placed face down either on a suitably designated area of the playing board or some other convenient location. Each of these cards, identifies by suitable indicia a cultural event and its location on the playing board.

In accordance with the present invention, the game pieces are moved from a designated start position to each point of interest listed on the travel itinerary card. In order to move a game piece into a particular point of interest, the player must have the corresponding point of interest card in his or her possession. If the player does not, then when it is his or her turn, the player picks an additional point of interest card from those cards lying on the playing board while discarding an unwanted point of interest card. Thus, each player attempts to obtain all of the point of interest cards listed on the travel itinerary card so that the game pieces can be moved into position to capture all of the points of interest.

Each player has the opportunity to move one or more game pieces in accordance with the number of spaces determined by the roll of the dice, for example. Each game piece is moved toward one of the points of interest. Once a game piece reaches a point of interest it is captured. The game is won by the first player who captures all of the points of interest listed on his or her travel itinerary card.

Movement of the game pieces around the playing board may be facilitated when the game piece lands on an event space. When this happens, the player may select an event card which describes by word and/or pictorial indicia a cultural event and its location on the playing board. The player may then move the particular game piece to any space identified by the particular event as shown on the event card. The player will select the space within the area of the event that is closest to the point of interest he or she needs to capture.

The present invention provides a game of amusement which enables the players to gain familiarity with actual geographical locations and cultural events associated therewith and to improve their skills in reading maps. The playing board may be sized to require young children to move around the board and thereby develop motor skills.

During the course of playing the board game apparatus, each player retains spatial parameters when visually scanning the playing board and maintains the spatial relationship of the game pieces to the desired points of interest. If multiple game pieces are used, the player must keep track of the relative position of each game piece thereby enhancing cognitive skills.

More complex skills are developed as the result of coordinating the location of the game pieces, points of interest, streets and game cards showing the points of interest and the travel itinerary. As a result, the present invention provides for the unique combination of teaching cultural aspects of geographic entities such as cities and developing those skills which enhance map reading.

Figure 1B:
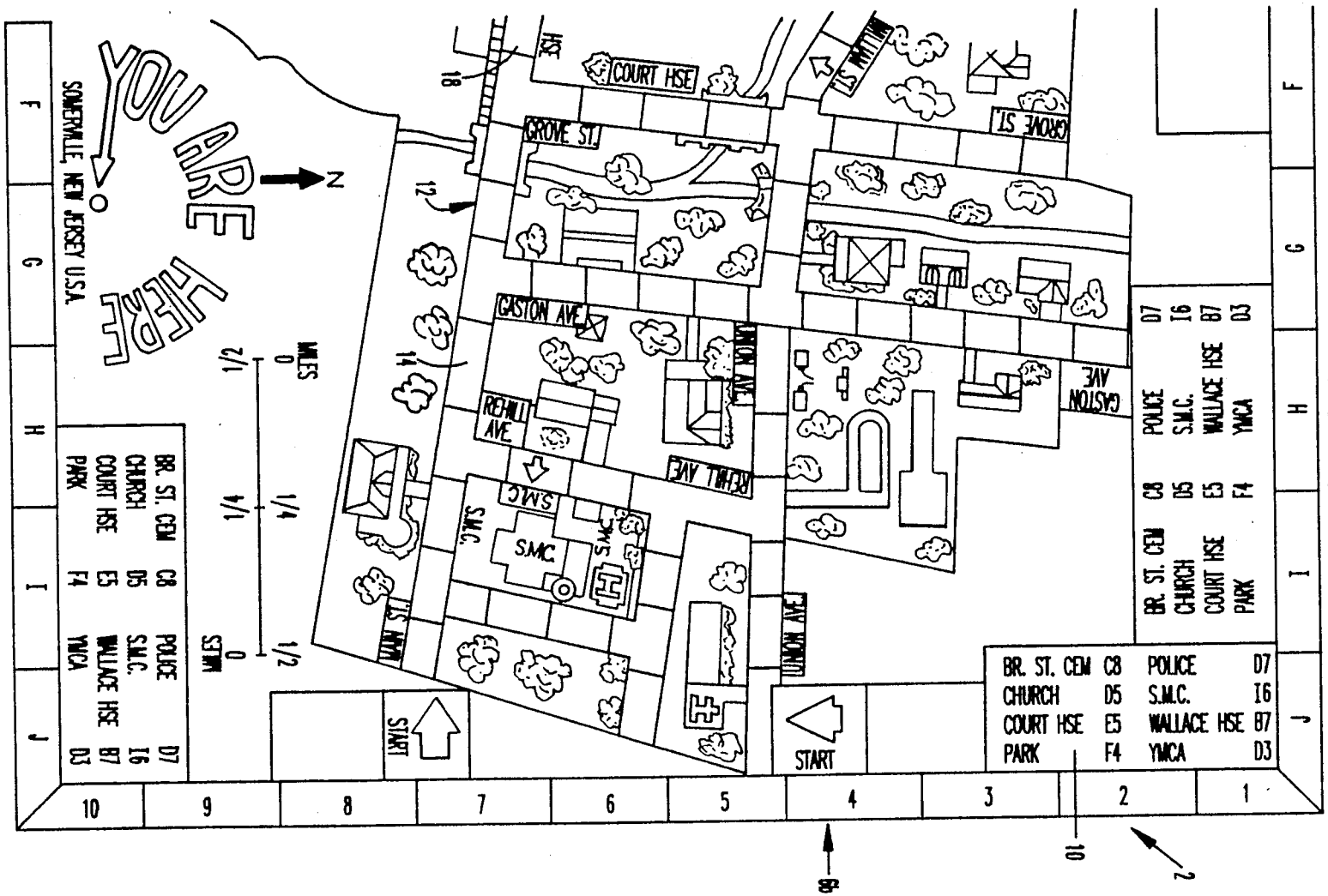

Referring to the drawings and particularly to FIG. 1, there is shown a representation of an aerial view of Somerville, N.J., in the form of a substantially rectangular playing board 2. In general, the playing board 2 shows by word and/or pictorial indicia major points of interest found in Somerville, N.J. such as, for example: parks, churches, schools, municipal buildings, and cemeteries.

The borders of opposed sides 4*a*, 4*b* of the playing board 2 have letter indices A–J while the borders of opposed sides 6*a*, 6*b* have number indices 1–10. The intersection of the respective indices define grids 8 for the location of the points of interest and events on the playing board 2. For example, the church is located in a grid intersected by the letter index D and the number index 5.

To assist the player in locating the points of interest, each of the sides 4*a*, 4*b*, 6*a*, 6*b* is provided with a legend 10 listing each point of interest and its location on the playing board by the letter and number indices.

The playing board 2 includes a series of streets 12 broken up into segments or spaces 14, upon which the players move the game pieces in search of designated points of interest. The spaces 14 may vary in length to offset the differences in the proximity of the respective starting points to the points of interest. An arrow 16 is provided in those spaces which indicate entry into a particular point of interest. For example, an arrow 16*a* identifies the entry point into the police station located in the grid E7.

A minor portion of the spaces 14 are designated "Events". When a player lands on an event space 18, he or she selects an events card 20 (See FIG. 4) which has words and/or pictorial indicia representing a particular event in Somerville, N.J., such as "Cruisin' Friday Night". As shown in the events card of FIG. 4, "Cruisin' Friday Night" is run in a region 22 of the playing board extending from East Main St. in grid E6 to West Main St. in grid C5. The player may therefore move the game piece from the events space 18 to any space located in the region 22 as indicated on the events card 20. In a preferred form of the invention, the events spaces may be identified by different colors and the corresponding events cards identified by the same colors.

Figure 2:
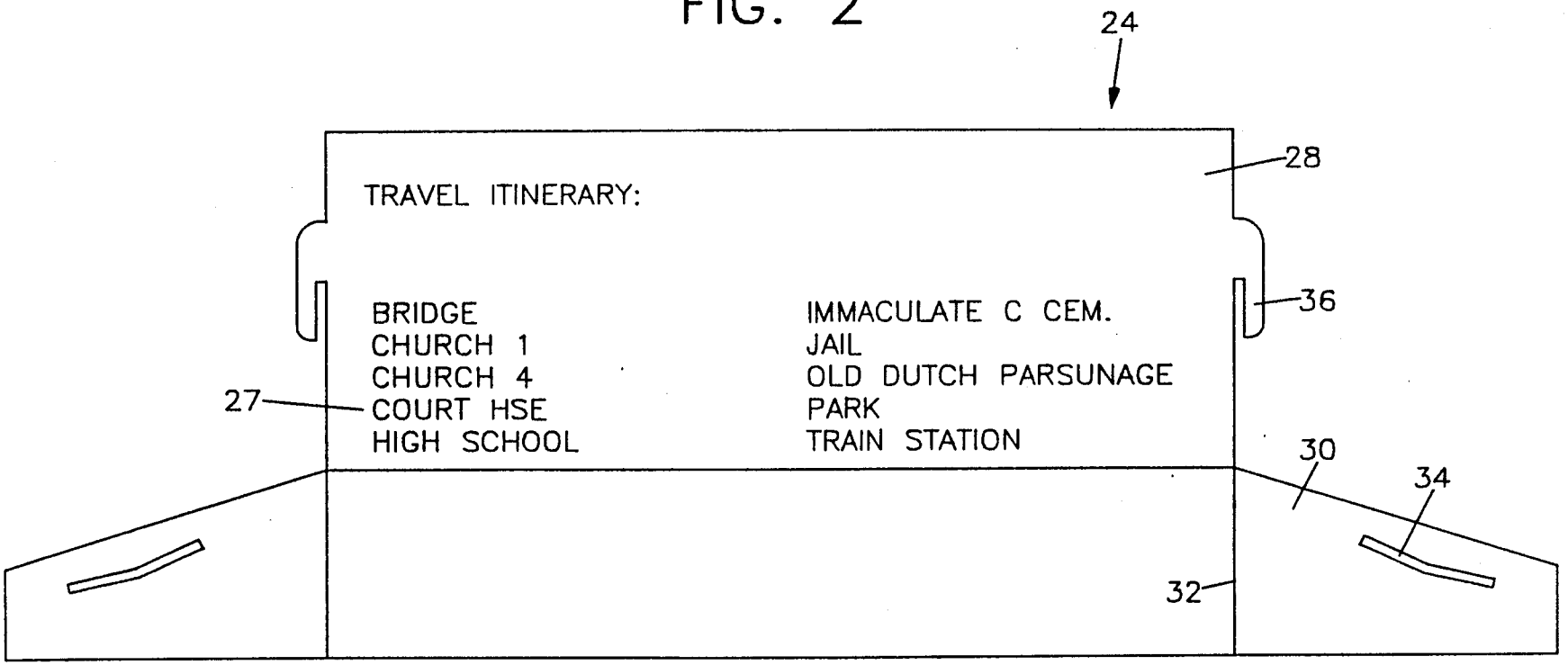
FIG. 2 is a perspective view of a travel itinerary card used in the present invention.

Before starting the game each player is provided with a single travel itinerary card 24 (see FIG. 2) and a plurality of point of interest cards 26 (see FIG. 3), preferably ten, such cards. Referring to FIG. 2, the travel itinerary card 24 includes a face portion 28 having thereon a list of points of interest 27 which must be visited by the player's game pieces. The card 24 is retained by the player in a manner which keeps the face portion 28 out of view of the other players so that they are not aware of his or her destinations.

This is preferably accomplished by providing the face portion 28 with outwardly extending wing portions 30 which may be rotated along creases 32. Each wing portion 30 is provided with a slot 34 for receiving a corresponding tab 36 extending from the face portion 28. When the tabs 36 are secured in the slots 34, the travel itinerary card 24 can stand upright without assistance from the player. In the example of the travel itinerary card 24 shown in FIG. 2, ten points of interest 27 are listed thereon. Accordingly, each player receives ten separate point of interest cards.

Figure 3:
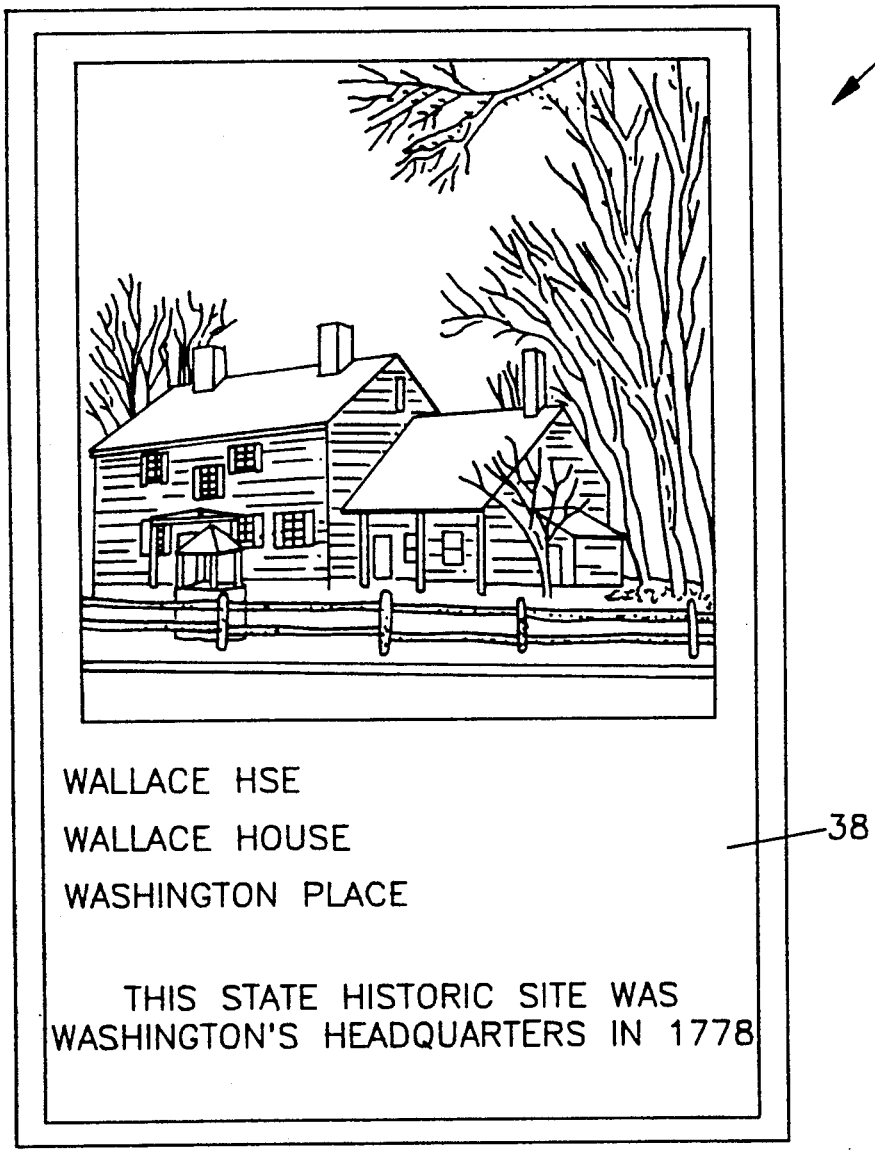
FIG. 3 is a perspective view of a point of interest card used in the present invention.
Figure 5:
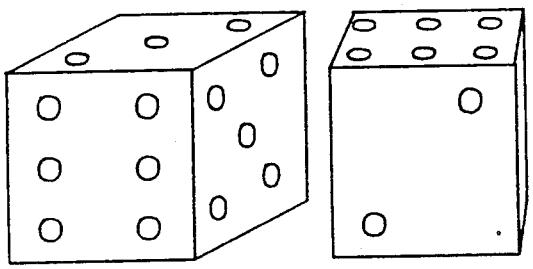
FIG. 5 shows a means for selecting a number of spaces for moving a game piece along a street in the direction of a point of interest.
Figure 6:
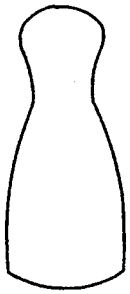
FIG. 6 shows a game piece for moving along spaces on the playing board.

Referring to FIG. 3, the point of interest card 26 has a face portion 38 having by words and/or pictorial indicia, a representation of one of the points of interest shown on the playing board. The card 26 shown in FIG. 3 depicts in words and pictorial indicia, by way of example, the Wallace House shown in grid B7. In a preferred form of the invention, the point of interest card 26 is an actual photograph at ground level or a perspective illustration of the point of interest portrayed in an aerial view on the game board. This format enables the player to better conceptualize the point of interest and its relationship to the total geographical area represented on the playing board. In addition, the point of interest card may include a narrative further describing the particular point of interest, as specifically illustrated in FIG. 3.

The number of point of interest cards held by all of the players is exceeded by the total number of such cards. Those point of interest cards not held by the players are placed on the playing board 2 or other suitable location to be exchanged by those players who are attempting to obtain the point of interest cards needed to match the list on the travel itinerary card 24.

Referring to FIG. 4, there is shown an events card 20 having a face portion 38 showing the location of the "Cruisin' Friday Night" event.

This particular event is indigenous to Somerville, N.J. although more general events, such as the site of a Memorial Day Parade may be depicted. As shown in FIG. 4, the route of the event is shown by arrows 40. Typically, the events card 20 provides sufficient detail around the route of the event that the player can readily identify the event location. As shown specifically in FIG. 4, several streets including Grove Street, Davenport Street and Bridge Street, as well as points of interest (i.e., the Court House and the church) are illustrated to assist the player in easily locating the route of the event. This is another manner in which map reading skills are facilitated by the game board apparatus of the present invention.

To begin the game, each player chooses the color of the game pieces that he or she would like to use for the game. The number of game pieces for each player should correspond to the number of points of interest listed on the travel itinerary card. Each player rolls the dice, for example, to determine who goes first. The player who rolls the highest number on the dice goes first and decides from which "start" point to begin. The player with the next highest number is the second to choose the start point and so forth.

Each player receives a single travel itinerary card prior to the start of the game. The points of interest listed on a player's travel itinerary card are the ones that he or she seeks to reach with his or her game pieces. The points of interest on the travel itinerary card do not have to be reached in any particular order.

Point of interest cards are then distributed to the players until each player has the same number of cards as the number of points of interest listed on the travel itinerary card. Each point of interest card corresponds to a point of interest on the playing board. The remaining point of interest cards are then preferably placed face down and side by side (not one on top of another) in an area that can be reached by all players e.g., inside of the box lid.

Since the point of interest cards that a player receives may or may not match the points of interest on his or her itinerary list, each player strives to match his or her point of interest cards with the ones on his or her list. This is done by picking up a card from the remaining point of interest cards, and replacing it with one in his or her hand which is not on his or her list. The discarded point of interest card is placed face down with the remaining cards. The player then rolls the dice and moves his or her game pieces toward the particular points of interest.

The players travel to their points of interest by moving their game pieces in any direction along the streets from space to space. The number that a player rolls on the dice is the number of spaces that he or she can move.

The legend found on each side of the playing board is used to assist the player in finding the approximate locations of the desired points of interest. Each legend contains spatial coordinates for all points of interest present on the playing board. The location of a particular point of interest is found by locating the grid defined by the particular letter and number indices.

Players may move any number of their own game pieces for the total number of moves that the player has rolled. A player who has rolled a six can, for example, move one game piece six spaces, six games pieces one space apiece or any combination totalling six spaces.

Each events card corresponds to a particular event which actually occurs in a portion of the city. If a player lands on an "events" space, he or she takes the uppermost "events" card of the same color as the "events" space. That player, if he or she chooses to use that card, is permitted to move the game piece to any space along the entire route of the event.

If the player chooses not to use the "events" card, he or she simply returns it to the bottom of the stack of "events" cards and moves the game pieces as if the "events" space were no different than any other space.

The diagram found at the bottom of each "events" card outlines the entire route of the event. The cards are color coded preferably by location. Any color game piece may land on and use any color "events" space and "events" card.

A player may move the game pieces into points of interest listed on his or her travel itinerary card, provided he or she also possesses the corresponding point of interest cards. Those cards are then placed face up and turned away from that player along the edge of that player's side of the board. This enables other players to see which points of interest on the board have been successfully reached.

Throughout this application, various publications have been referenced. The disclosures in these publications are incorporated herein by reference in order to more fully describe the state of the art.

While the invention has been particularly described in terms of specific embodiments, those skilled in the art will understand in view of the present disclosure that numerous variations and modifications upon the invention are now enabled, which variations and modifications are not to be regarded as a departure from the spirit and scope of the invention. Accordingly, the invention is to be broadly construed and limited only by the scope and spirit of the following claims.

I claim:

1. A board game apparatus for educating a player about the culture of a geographic entity comprising:

(a) a playing board having thereon a representation of a select geographic entity including points of interest and streets, the streets being divided into a plurality of spaces for receiving a game piece, wherein a minor portion of said spaces are event spaces;

(b) at least one game piece for moving along said spaces;

(c) at least one point of interest card having thereon points of interest shown on the playing board;

(d) a travel itinerary card having described thereon at least one point of interest that must be reached by the player;

(e) means for selecting a number of spaces for moving the game piece along a street in the direction of a point of interest described on said players point of interest card and travel itinerary card; and (f) a plurality of event cards identifying a cultural event located on the playing board such that when a player lands on an event space, the player selects an event card and moves one of his game pieces to any space identified by the event shown on the event card;

wherein the playing board comprises a listing of the points of interest and a corresponding grid in which each point of interest is located.

2. The board game apparatus according to claim 1, wherein the select geographic entity is a city.

3. The board game apparatus according to claim 1, wherein the representation of the geographic entity is an aerial diagram.

4. The board game apparatus according to claim 1, wherein the point of interest shown on the point of interest card is described by word, pictorial indicia or a combination thereof.

5. The board game apparatus according to claim 1, wherein the playing board further comprises indicia positioned along the perimeter thereof defining a plurality of grids for locating said points of interest and streets.

6. The board game apparatus according to claim 5, wherein the playing board has a pair of opposed sides, one of said pair of opposed sides having letter indicia and the other of said pair of opposed sides having numeric indicia whereby each of said grids are identified by a letter and a number.

7. The board game apparatus according to claim 1, wherein the representation of the point of interest on the point of interest card is a photograph or a perspective illustration.

8. The board game apparatus according to claim 1, wherein the apparatus has ten game pieces, ten point of interest cards, and said travel itinerary card describes thereon ten points of interest.

9. The board game apparatus according to claim 1, wherein the total number of point of interest cards exceeds the sum of the number of point of interest cards held by the players.

* * * * *